United States Patent [19]

Nevins et al.

[11] 4,403,005

[45] Sep. 6, 1983

[54] SYSTEMS FOR PROTECTING STEEL

[75] Inventors: Norman Nevins, Dayton; Robert L. McVay, Cincinnati, both of Ohio

[73] Assignee: Protective Treatments, Inc., Dayton, Ohio

[21] Appl. No.: 234,909

[22] Filed: Feb. 17, 1981

[51] Int. Cl.[3] ..... B32B 3/14; E04F 13/08

[52] U.S. Cl. ..... 428/48; 52/309.1; 52/309.3; 52/389; 52/390; 428/47; 428/54; 428/462

[58] Field of Search ..... 428/47, 54, 57, 48, 428/462, 189; 260/42, 47, 33.6 AQ; 52/390, 309.3, 309.1, 389

[56] References Cited

U.S. PATENT DOCUMENTS 3,896,245 7/1975 Sato et al. ..... 428/7

*Primary Examiner*—Paul J. Thibodeau

*Attorney, Agent, or Firm*—Dressler, Goldsmith, Shore, Sutker & Milnamow, Ltd.

[57] ABSTRACT

A steel bridge deck surfaced with plastic tiles is disclosed in which the tiles are bonded to the deck by means of a bonding layer having a Shore 00 hardness of from 78 to 90 and comprising an elastomer compounded with a stiffening filler in an amount equal to at least half the weight of the elastomer. Low volatile liquid plasticizer is present in an amount to provide the stated hardness. The elastomer is preferably a mixture of acrylic elastomer and butyl elastomers, and the stiffening filler is a high abrasion furnace carbon black. The tiles are adhered to the layer with a solution coating comprising neoprene in admixture with a terpene-phenolic resin and the coating desirably includes a hydrophobic silica. The layer is adhered to the steel deck with a butyl-based solution coating containing a corrosion-resistant pigment in combination with zinc oxide.

16 Claims, 1 Drawing Figure

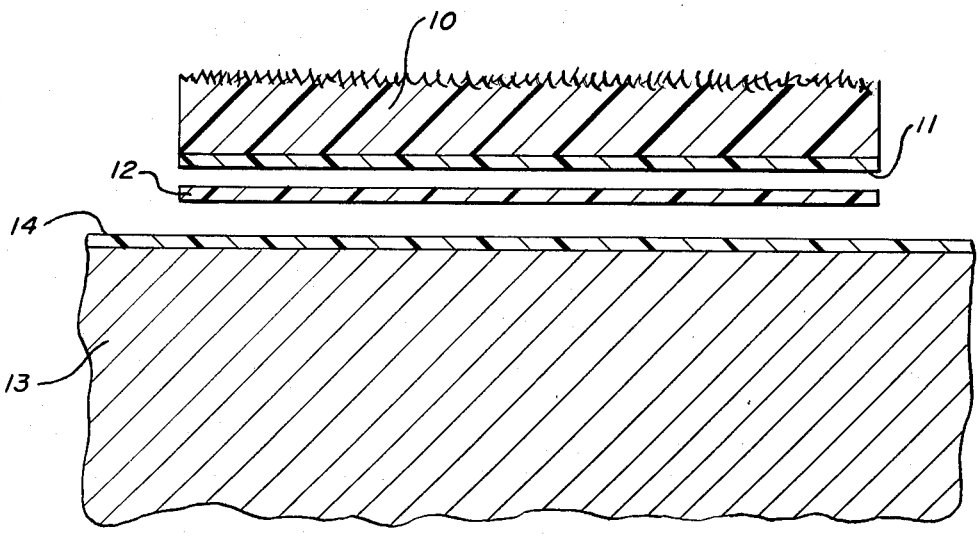
10
11
12
14
13

SYSTEMS FOR PROTECTING STEEL

DESCRIPTION

Technical Field

This invention relates to the bonding of wear surfaces to bridge decks, and it includes protection of the steel bridge deck which tends to corrode, particularly when salt is applied during the winter to prevent icing.

Background Art

Plastic tiles, and especially molded fiber-filled polyurethane tiles, are now being tested for use as wear surfaces for vehicular traffic. However, it has not been practical to use this concept on a steel bridge deck because the lack of an adequate bond allows the tiles to move and be pushed out of place by the pressure of the vehicles passing thereover. Also, the adhesive system which holds the tiles in place must protect the steel surface of the bridge from corrosion, and this has been difficult to achieve. It is here intended to provide a bonding system which will hold the tiles in place and which will protect the steel bridge deck surface from the corrosive tendency of the weather and from salt applied in the winter in order to minimize icing. This bonding system must be able to sustain itself under widely varying conditions of temperature, humidity and mechanical stress.

Disclosure of Invention

We have found that a properly filled and plasticized elastomer layer can be bonded to the tile and to the steel deck with the layer being soft enough to avoid cracking at low temperature while, at the same time, being stiffened sufficiently to prevent the impact of passing vehicles from squeezing the layer out from between the steel deck and the tiles. Such an elastomer layer is plasticized to have a Shore 00 hardness of from 78 to 90, preferably 80 to 85, and adequate stiffness is provided by using a stiffening filler, especially carbon black, in an amount at least equal to half the weight of the elastomer, preferably at least equal to the weight of the elastomer. Most satisfactory stiffening is achieved using a carbon black designated ASTM N-330 which provides greater stiffness than any other stiffening filler. Carbon blacks designated ASTM N-326, N-347 and N-351 are also good. These preferred blacks are known as high abrasion furnace blacks.

The elastomer is preferably a mixture of a butyl rubber having a molecular weight of at least about 300,000 with a butyl rubber which is cross-linked, as by the presence of 0.5–3% of divinyl benzene, to provide a solubility in cyclohexane of about 15% to about 25% in combination with a small proportion of an acrylic elastomer. An acrylic elastomer is a high molecular weight polyacrylate or polymethacrylate having a $T_g$ in the range of −10° C. to −40° C., preferably −15° C. to −25° C. Oils, greases, gasoline drippings, and the like, swell butyl rubber, and the presence of the acrylic elastomer prevents excessive swelling. A weight ratio of from 1:10 to 1:4 (acrylic to butyl) represents an appropriate proportion of the acrylic elastomer. A typical acrylic elastomer is provided by copolymerizing in bulk a blend of ethyl acrylate and butyl acrylate which provides a $T_g$ of −18° C. As is well known, $T_g$ identifies the glass transition temperature which is a known quantity for each monomer. The $T_g$ of the blend can be calculated from the $T_g$ of each monomer and its proportion in the copolymer which is formed.

The plasticizers which can be used are illustrated by processing oil which is a low molecular weight polyisobutylene, but a large variety of low volatile liquid softeners are also useful, and these are more fully illustrated in Seto and Thompson U.S. Pat. No. 3,896,245 issued July 22, 1975.

The elastomer layer will normally have a thickness in the range of about 0.125 to 0.25 inch. The layers may have any desired width and may be tile length or longer (in which case the layer is supplied as a coil wound together with a separating layer). A typical width would be 12 inches. The layer is formed by extrusion, and it is difficult to extrude very thin layers. This provides a practical factor which bears upon the minimum thickness. Cost bears upon the maximum thickness. We prefer a thickness of 0.20 inch.

In order to bond the elastomer layer to the tile, it must be recognized that molded tiles are surfaced with mold release agents which interfere with the wetting of the tile and the achievement of a good bond. We have found that adhesion of the tile to the butyl tape can be obtained by using a coating containing neoprene in admixture with a terpene-phenolic resin, these being applied to the undersurface of the tile from an organic solvent solution of the mixed resins.

Neoprene (chemically known as polychloroprene) is known for use in contact adhesives which supply a tacky surface, but the tile coatings which are used herein exhibit no surface tack when dried. Despite the lack of tack, the coated and dried tile surface bonds strongly to the elastomer layer on the application of pressure. Neoprene W provides distinctly superior results, and is preferred. Neoprene W is constituted by 85% by weight of the trans isomer of polychloroprene, and it is preferred to use a neoprene having a trans isomer content of at least 60%.

Terpene-phenolic resins are themselves known materials. These are non-heat hardening condensates of formaldehyde with a mixture of pinene and a phenol. The pinene may be alpha or beta pinene or a mixture thereof, and the phenol may be any of the usual phenols used in phenol-formaldehyde resins, such as t-butyl phenol or para-octyl phenol. The pinene component will constitute from 10% to 40% by weight of the mixture thereof with the phenol component. The proportion of formaldehyde is determined by the desired non-heat reactive nature of the condensate. A typical terpene-phenolic resin available in commerce can be obtained from Reichhold Chemical under the designation Nirez-2040.

The terpene-phenolic resin is used in admixture with the neoprene resin in a weight ratio of 1:3 to 3:1, preferably a ratio of 1.2:1 to 1:1.2. This preferred ratio represents a larger amount of the terpene-phenolic resin than would normally be considered to be appropriate in a contact adhesive.

The organic solvent selected for use in these coatings is of little importance, methyl ethyl ketone being an illustrative useful solvent.

The solution of neoprene and terpene-phenolic resin importantly includes a hydrophobic silica in an amount of at least 60% of the weight of the neoprene, such as Aerosil 972 (Degussa) to provide resistance to water in combination with superior adhesion. Up to about 100% of silica, based on the neoprene, can be accepted.

An amino silane adhesion promoter may also be present. These are known and are convention for this purpose.

A corrosion-resistant bond is needed to hold the elastomer layer to the steel substrate. We have found that a butyl-based solution coating containing a corrosion-resistant pigment in combination with from 30 to 70 parts of zinc oxide per 100 parts of butyl elastomer will provide a good bond in combination with good resistance to environmental conditions and aqueous salt. This zinc oxide-pigmented butyl coating is applied to the steel substrate and air dried prior to application of the elastomer layer. From 5% to 20% of butyl rubber (mol. wt. at least 300,000) is usually used.

Corrosion resistant pigments are well known and are illustrated herein by zinc chromate or strontium chromate. These are used in an amount of about 0.5 to 1.5 pounds per gallon of coating.

The solvent used is selected for its capacity to dissolve the resins. Aromatic solvents, such as toluene, are preferred.

BEST MODE FOR CARRYING OUT THE INVENTION

Example 1 (Primer for Steel Bridge Deck)

To a Day high torque double arm mixer add 375 pounds of a butyl masterbatch made by mixing 44 parts of high molecular weight butyl rubber (Exxon Butyl 268, mol. wt.=350,000), 22 parts zinc oxide, 4 parts of fine extrusion furnace carbon black, 13 parts of fumed silica, 9 parts of liquid epoxy resin (diglycidyl ether of bisphenol A having an epoxide equivalent weight of 180) and 8 parts of processing oil in a Banbury mixer for 5 minutes at 348° F. To the Day mixer is then added 82 pounds of nonheat hardening para-octyl phenol-formaldehyde phenolic resin and 65 pounds of low molecular weight polyisobutylene (mol. wt.=about 11,000) while mixing. Mixing is continued for 15 minutes without further additions. Then add 46 pounds of naphthenic oil (ASTM D-2226 type 103). While still mixing add 65 pounds of fine extrusion furnace carbon black and mix 60 minutes to insure its proper dispersion.

Toluene in a total amount of 1547 pounds is added incrementally while mixing continues. After 75% of the toluene is present, 4.48 pounds of lead dioxide are added followed by 2.24 pounds of quinone dioxime. Immediately thereafter, 230 pounds of zinc chromate are added and then the balance of the toluene, and mixing is continued to uniformity. Lastly, 55.8 pounds of amino silane adhesion promoter (Union Carbide A-1100) is added as a 50% solution in mineral spirits. This is the form in which adhesion promoter is added hereafter.

Prior to use, toluene is added to obtain a viscosity of 50 seconds in a No. 4 Ford Cup at 77° F.

The mixing operations described above are carried out with cooling water running in the cooling jacket of the Day Mixer to minimize heating.

Example 2 (Deck Tile Primer)

A Shar mixer which includes a high speed central agitator and a peripheral scrapper is charged with 1920 pounds of methyl ethyl ketone followed by the addition of 126 pounds of terpene phenolic resin (Nirez-2040) while the mixer is running to provide a resin solution. 120 pounds of Neoprene W (du Pont) are added and the mixer is run for 2 hours to dissolve the neoprene. 2 pounds of amino silane adhesion promoter are then added and mixed in for 10 minutes. Lastly, 84 pounds of hydrophobic fumed silica are added and mixed in to provide a homogeneous mix having a viscosity of 15–35 seconds in a No. 4 Ford Cup at 77° F.

Example 3 (Production of Elastomer Layer)

Charge a Day mixer with 235 pounds of high molecular weight butyl rubber (Mooney viscosity of 50–60 Mooney points measured at 127° C.) and then add 429 pounds of cross-linked butyl rubber (cross-linked with divinyl benzene to be about 20% soluble in cyclohexane). Then add 96 pounds of acrylic elastomer (bulk copolymer of ethyl acrylate and n-butyl acrylate having a $T_g$ of −18° C.), 65 pounds of para-octyl phenol-formaldehyde nonheat hardening phenolic resin, and 17 pounds of aluminum stearate, 100 pounds of polybutene (viscosity 3100 centistokes at 210° F.), and 200 pounds of N-330 carbon black, and operate the mixer for 1 hour to insure intimate admixture.

At this point 105 pounds of additional polybutene (3100 centistokes) are added and mixed in for 10 minutes and then 200 pounds of the N-330 carbon black and 100 pounds of lower viscosity polybutene (110 centistokes at 100° F.) followed by 10 minutes of mixing.

100 pounds of additional polybutene (110 centistokes) and 200 pounds of N-330 carbon black are added and mixed in for another 10 minutes.

100 pounds of additional polybutene 110 centistokes) and 115 pounds of N-330 carbon black are added and mixed in for another 10 minutes.

100 pounds of additional polybutene (110 centistokes, 130 pounds of precipitated hydrated silica (Hi Sil 233 from PPG Industries) and mix for another 10 minutes.

Then add 77 pounds of additional polybutene (110 centistokes) and mix for 15 minutes and then add 65 pounds of calcium oxide and mix 15 minutes, and then add 65 pounds of talc and mix in briefly (about 6 seconds) and stop the mixer and dump the product.

The above provides the following composition:

| Component | Pounds |
|---|---|
| Cross-linked butyl rubber | 429 |
| High mol. wt. butyl rubber | 235 |
| Phenolic resin | 65 |
| N-330 carbon black | 715 |
| Precipitated silica | 130 |
| Polybutene (110 centistokes) | 477 |
| Polybutene (3100 centistokes) | 205 |
| Calcium oxide | 65 |
| Talc | 65 |
| Aluminum stearate | 17 |
| Acrylic elastomer | 96 |

The mixing is done with water cooling in the cooling jacket. Despite this cooling, the temperature increases so that, when the product is dumped, it has a temperature of about 250° F.

Example 4 (Application)

The primer of Example 1 is coated upon a steel bridge deck after it has been sandblasted. The primer solution is applied in an amount of 0.4–0.6 gallons per 100 square feet by brush and the coating is dried. Drying is usually complete within about 15 minutes under ambient conditions. At any time after drying, the elastomer layer of Example 3 is laid upon the dried primer. Then, the precoated polyurethane tiles are placed down upon the elastomer layer (coated side down) and pressure is applied to assemble the system. 4000 psi pressure for 10 seconds is appropriate for this purpose.

The precoated tiles are formed by applying the primer of Example 2 to the underside of the tile, brush application being used. 0.3 gallons per 100 square feet are employed and the coating is air dried under ambient conditions for at least about 10 minutes. The coated tiles can be used at any time after drying.

Separating sheets may be used to prevent the elastomer layer from sticking prematurely, and the dried coating need not be protected, but should be kept clean prior to use.

BRIEF DESCRIPTION OF DRAWING

The invention is pictured in the accompanying drawing in which the single FIGURE is a diagramatic cross-section showing the system used in accordance with this invention.

Referring more particularly to the drawing, the numeral 10 identifies a fiber-filled polyurethane tile having its undersurface coated with a primer 11 and positioned atop an elastomer layer 12 which is placed on the steel bridge deck 13 which has been precoated. as shown at 14. This is the assembly which is subjected to pressure to provide the system of this invention.

What is claimed is:

1. A steel bridge deck surfaced with plastic tiles, said tiles being bonded to said bridge deck by means of a bonding layer having a Shore 00 hardness of from 78 to 90 and comprising an elastomer compounded with a stiffening filler in an amount at least equal to half the weight of the elastomer, and low volatile liquid plasticizer in an amount to provide the stated hardness.

2. A combination as recited in claim 1 in which said stiffening filler is a carbon black present in an amount at least equal to the weight of the elastomer.

3. A combination as recited in claims 1 or 2 in which said carbon black is a high abrasion furnace black.

4. A combination as recited in claim 2 in which said carbon black is of ASTM N-330 type.

5. A combination as recited in claim 1 in which said elastomer comprises a mixture of butyl rubber having a molecular weight of at least 300,000 and a butyl rubber cross-linked to about 15% to about 25% solubility in cyclohexane.

6. A combination as recited in claim 5 in which said elastomer includes an acrylic elastomer which is a high molecular weight polyacrylate or polymethacrylate having a $T_g$ in the range of $-10°$ C. to $-40°$ C.

7. A combination as recited in claim 6 in which the weight ratio of acrylic elastomer to butyl elastomers is in the range of from 1:10 to 1:4.

8. A combination as recited in claim 7 in which said acrylic elastomer is a bulk copolymer of ethyl acrylate and butyl acrylate having a $T_g$ of about $-18°$ C.

9. A steel bridge deck surfaced with plastic tiles, said tiles being bonded to said bridge deck by means of a bonding layer having a Shore 00 hardness of from 78 to 90 and comprising elastomer compounded with a stiffening filler in an amount at least equal to the weight of the elastomer, said elastomer being a mixture of acrylic elastomer and butyl elastomers in the weight ratio range of from 1:10 to 1:4, said acrylic elastomer being a bulk copolymer of acrylates and methacrylates providing a $T_g$ in the range of $-10°$ C. to $-40°$ C., said butyl elastomers comprising a mixture of butyl rubber having a molecular weight of at least 300,000 and a butyl rubber cross-linked to about 15% to about 25% solubility in cyclohexane, said stiffening filler being a high abrasion furnace carbon black, and low volatile liquid plasticizer is present in an amount to provide the stated hardness.

10. A combination as recited in claim 1 in which said plastic tiles are fiber-reinforced polyurethane tiles.

11. A combination as recited in claim 1 in which said tiles are adhered to said layer with the aid of a solvent solution coating applied to the underside of said tile and comprising neoprene in admixture with a terpene-phenolic resin in a weight ratio of from 1:3 to 3:1.

12. A combination as recited in claim 11 in which said neoprene comprises at least about 60% of the trans isomer of polychloroprene.

13. A combination as recited in claim 12 in which said neoprene contains about 85% of the trans isomer of polychloroprene.

14. A combination as recited in claim 11 in which said solution coating includes a hydrophobic silica in an amount of at least 60% of the weight of the neoprene.

15. A combination as recited in claim 1 in which said layer is adhered to said steel deck by means of a butyl-based solution coating applied to the steel deck and dried thereon, said solution containing a corrosion-resistant pigment in combination with from 30 to 70 parts of zinc oxide per 100 parts of butyl elastomer.

16. A combination as recited in claim 15 in which said corrosion resistant pigment is a chromate pigment used in an amount of from 0.5 pounds to 1.5 pounds thereof per gallon of coating.

* * * * *

UNITED STATES PATENT AND TRADEMARK OFFICE

CERTIFICATE OF CORRECTION

PATENT NO. : 4,403,005

DATED : September 6, 1983

INVENTOR(S) : Nevins et al

It is certified that error appears in the above-identified patent and that said Letters Patent is hereby corrected as shown below:

On the title page Inventors should read

-- (75) Inventors: Norman Nevins, Dayton; Robert L. McVay, Cincinnati; Carmen L. Bellanca, Centerville; Ohio --.

Signed and Sealed this

*Eighteenth* Day of *June 1985*

[SEAL]

*Attest:*

DONALD J. QUIGG

*Attesting Officer* *Acting Commissioner of Patents and Trademarks*